US005140769A

United States Patent [19]

Hickson et al.

[11] Patent Number: 5,140,769

[45] Date of Patent: Aug. 25, 1992

[54] SLIDING CENTER-PIVOTED WINDOW

[75] Inventors: Eugene F. Hickson, Butler; Maurice E. Sterner, York, both of Pa.

[73] Assignee: Renneson Inc., Saxonburg, Pa.

[21] Appl. No.: 622,495

[22] Filed: Nov. 27, 1990

Related U.S. Application Data

[63] Continuation-in-part of Ser. No. 146,303, Jan. 21, 1988, abandoned.

[51] Int. Cl.[5] ..... E05D 15/22

[52] U.S. Cl. ..... 49/186; 49/183

[58] Field of Search ..... 49/161, 162, 168, 169, 49/174, 176, 177, 186, 185, 172, 173

[56] References Cited

U.S. PATENT DOCUMENTS 3,105,576 10/1963 Jones ..... 49/172
3,461,608 8/1969 Johnson ..... 49/161
3,529,381 9/1970 Grossman ..... 49/176
4,222,201 9/1980 Yanessa ..... 49/174

FOREIGN PATENT DOCUMENTS 2834520 2/1980 Fed. Rep. of Germany ..... 49/177

*Primary Examiner*—Gerald A. Anderson

[57] ABSTRACT

A window having at least one slidable sash which is capable of being pivoted about a central axis. It may include among its features a selectively movable weather-stripping between stiles, a latch between non-rotating and rotating portions of the sash to prevent rotation, double weather-stripping between sash and frame members to optimize integrity of the window against air and water infiltration, and cooperation between the rails and head and still members to prevent the rails from being separated from the frame where the rotatable portion of the sash is in an open, rotated position for cleaning.

11 Claims, 7 Drawing Sheets

SLIDING CENTER-PIVOTED WINDOW

CROSS-REFERENCED TO RELATED APPLICATION

This is a continuation-in-part Application of U.S. Ser. No. 146,303 filed Jan. 21, 1988, now abandoned.

BACKGROUND OF THE INVENTION

This invention relates to a window and more particularly to a window having one or more sliding sash which are pivotable about an axis substantially at the sash mid-point for convenience in cleaning the sash exterior.

Vertical and horizontal sliding windows are well known. Typically a sliding window has one or more sash, usually two, mounted in a frame. One or both of the sash are adopted for sliding in the frame. To prevent or minimize air and water infiltration, weather-stripping is provided between all of the movable and fixed frame members and between meeting sash members.

Typically, the window exterior is cleaned from the exterior, but an ever increasing number and particularly residential windows, are adapted so that the exterior of the sliding sash can be cleaned from the building interior. Some are adapted so that the sash can be removed from the frame while others enable the sash to be tilted, rotated, or swung into the building interior. Gurniak U.S. Pat. No. 3,041,680, for example, shows a horizontal sliding sash which can be swung into the interior. As the sash is slid in the frame and approaches the full extent of its opening, it is cammed upwardly to be out of retention of the frame and a hinge arrangement between the frame and sash stile enables the sash to be swung inwardly for cleaning. Although such a pivotable arrangement may be more convenient than lifting and removing the sash, it has its disadvantages as well. It may be seen as well that the total weight of the sash is borne by the swing mechanism. If the sash is large, the weight can be substantial and create concentrated forces on the mechanism to cause failure or spring the mechanism in a manner that problems in aligning the sash for closing arise. Since the total width of the sash swings inwardly, cleaning may require moving furniture before the sash can be swung inwardly. Travis U.S. Pat. No. 2,744,296 shows a sash which pivots about a central axis which is an improvement in the sense that less room is required to gain access to the sash exterior. Also, there is far less less load or strain on a center-pivot mechanism than one that supports the weight at a stile connection. Travis, however, does not describe a sliding window. The sash is adapted for side movement, but only to the extent required to clear one of the stiles from the frame so that the sash can be rotated. Furthermore, to provide seals against water and air infiltration, Travis' window requires bars on the head and sill members which have to be moved vertically clear of the sash before it can be pivoted. Travis does not make a suggestion of any kind for providing a sliding center-pivoted sash.

Jones et al U.S. Pat. No. 3,105,576 is the only patent noted which describes a window having a center-pivoted sash which also slides. Jones at al teaching, however, is directed only to a vertical double hung-window and makes no suggestion for constructing a horizontal sliding window having center-pivoted sash. Although the Jones et al proposal of providing a center-pivoted sliding sash is advantageous the teaching is directed only to vertical sliding double-hung window. Furthermore, the design proposed by Jones et al requires that the sash be removable from the frame which negates providing a positive interlock between between the sash and frame. The advantages a such a positive interlock will be explained in greater detail in the following discussion of the present invention. It would be desirable, therefore, to provide a center-pivoted sliding window having features which may be used to advantage in either a horizontal or vertical sliding window.

SUMMARY OF THE INVENTION

The present invention is a window which includes one or more sliding sash which are center-pivoted to provide easy access to the sash exterior from the building interior. Each sliding sash has members which are split lengthwise with the split members pivotably connected at the midpoints. In a horizontal window, the split members are the sash rails and in a single or double-hung window the split members are the sash stiles. One of the portions of each split member slides within the frame and is non-rotating while the other portions are adapted to retain the glass. Thus, a sash can be slid to position where the ends of the split members are free of the frame and the glazed portion of the sash can then be rotated about the central axis. Secure, positive, non-protruding locking mechanisms are provided at the ends of the split members to prevent the sash from pivoting except when desired. For optimal protection against air and water infiltration, weather-stripping is provided on both the interior and exterior of all the sash members which fit within the frame. Continuous weather-stripping and a pressure equalization chamber along the seam between the portions of the split members prevents air and water infiltration through the seam when the sash is secured against rotation. A selectively movable weather-strip member between meeting stiles or rails, as the case may be, provides a seal therebetween with the sash in a closed position. Thus weather stripped, a window of this invention protects against air or water infiltration into the building even in high wind conditions.

Maintaining a proper space between the split members is important to provide sufficient compression of the weather-strip to insure a seal without creating excessive resistance to rotation of the glazed sash portion. To insure such proper space between opposing portions of the split members is maintained, a spring means adapted for sliding contact with the frame is attached to at least one of the non-rotating portions of a split member between such portion and the frame.

An additional feature of each of the sliding sash is a slidable connection between the non-rotating portion and the frame to prevent removal of the non-rotating portions from the frame when the rotating portion of the sash is in a rotated open position.

It is the objective of this invention to provide a sliding window having a center-pivoted sash for easy access to the sash exterior from the interior of the building.

It is a further objective of that such a window be provided with weather-stripping suitable for providing optimal protection against the infiltration of air and moisture into the building interior.

It is also an objective that with a rotatable portion of the sash in a rotated open position, the sash can not be removed from the frame.

The above and other objectives and advantages of this invention will be more readily apparent with reference to the following description of a preferred embodiment and the accompanying drawings.

DESCRIPTION OF A PREFERRED EMBODIMENT

A preferred embodiment of this invention will be described with reference to a horizontal sliding window having two sash adapted for sliding by one another. It is noted, however, that it is not intended that this invention be limited to such a window since its features may be advantageous for any sliding window.

Figure 1:
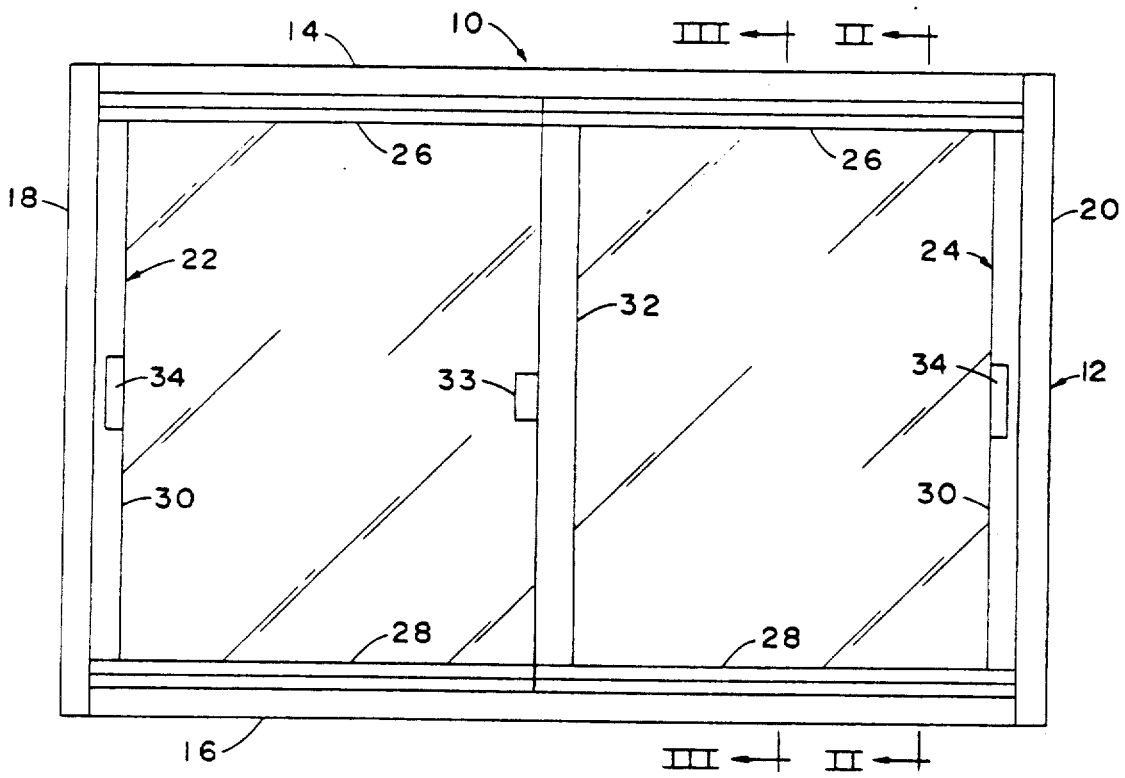
FIG. 1 in an interior view of a window of this invention.

Referring first to FIG. 1, a window 10 includes a rectangular frame 12 which is adapted for fitting within an opening and attachment to a wall in a building, mobile home, boat, or the like. The frame 12 has a head 14, sill 16, left jamb 18 and right jamb 20. A left hand sash 22 and a right hand sash 24 fit within the frame 12 and are adapted for sliding movement past one another as will be discussed in greater detail later. The frame 12 can be assembled with butt or mitered joints between the jambs, head and sill as a matter of choice and with methods and details of connection known to those skilled in the art.

The sash 22, 24 have top and bottom rails 26, 28, pull stiles 30 and meeting stiles 32. Only the right sash meeting stiles 32 is visible in FIG. 1 since the left sash meeting stile is behind it when the sash are in closed positions. A lock mechanism 33 is attached to the right meeting stile 32 which engages with the left meeting stile. Each pull stile 30 is provided with an outwardly projecting handle 34 for grasping to slide the sash. Each bottom rail 28 has rollers which ride along an inner surface of the sill 16 to give the sash sliding movement.

Figure 2:
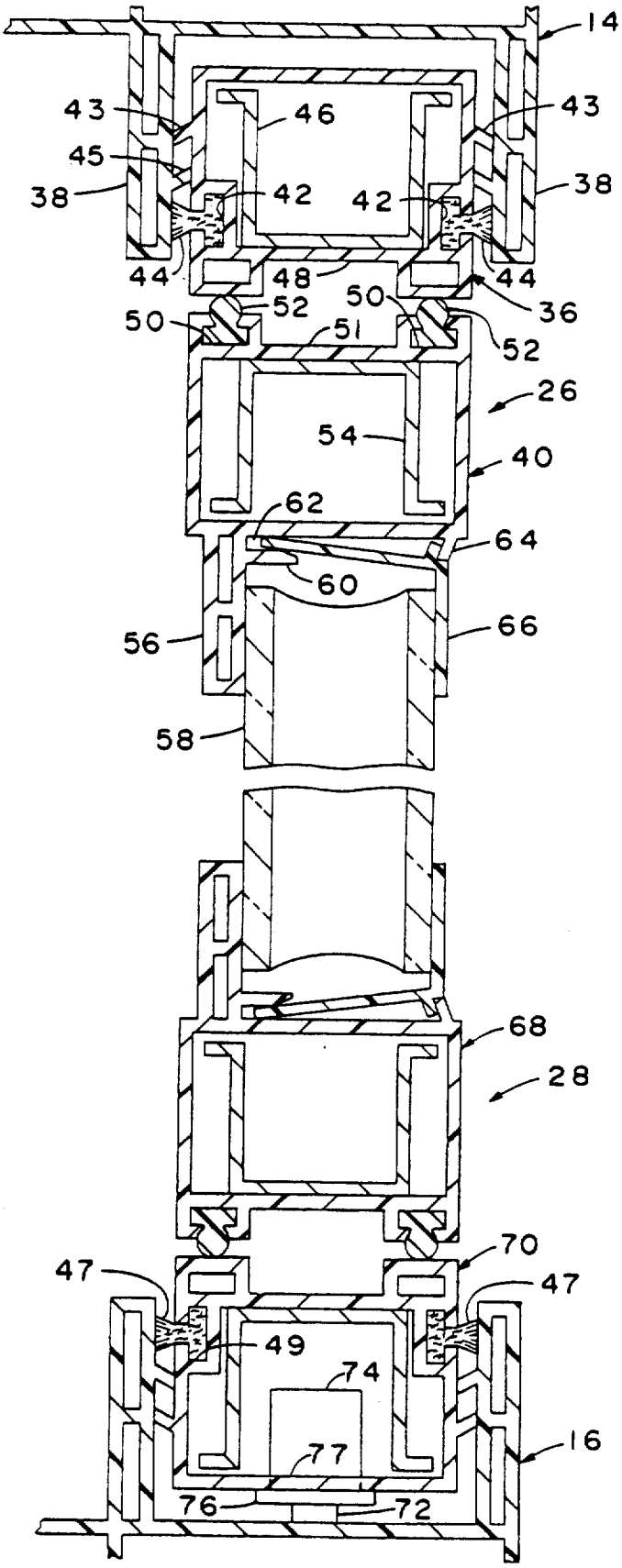
FIG. 2 is a vertical cross-section of one of the sash and frame members of the window shown in FIG. 1 along Section II—II.

Referring now to FIG. 2, features of the top and bottom rails 26, 28 will be discussed in greater detail. The top rail 26 is divided into two separate portions, an upper portion 36 housed within flanges 38 on the frame 14, and a lower portion 40 which is rotatably attached to the upper portion 36 as will be explained later. The upper portion 36 is an extruded rectangular plastic tube which has an inwardly projecting recess 42 in each of its sidewalls to accommodate a continuous, compressible weather-strip member 44, to effect a weather seal between the upper portion 36 and the fixed frame 14.

Each tube sidewall also has a lip 43 projecting outwardly and downwardly and slightly spaced away from lip 45 projecting outwardly and upwardly from the frame flanges 38. The function of these opposing lips 45, 45 will be discussed later. An aluminum channel 46 extends for substantially the full length within the plastic tube to stiffen and reinforce it. An inwardly projecting recess 48 is provided in the bottom wall for reasons to be discussed later.

The lower rotating portion 40 is a rectangular plastic tube having a width identical to the upper portion 36. Recesses 50 in the top wall retain continuous compressible weather-stripping members 52 to effect a weather seal between the upper and lower portions 36, 40. A central recess 51 is also provided in the top wall of this lower rotating portion 40 for a reason to be discussed later. A reinforcing channel 54 identical to the channel 46 in the upper portion extend within the lower tube for substantially its full length to stiffen and reinforce it. A glazing leg 56 projects away from the bottom wall adjacent the junction of the bottom wall and the outer side wall to provide support for the glass 58. A flange 60 projects outwardly from the inner surface of the glazing leg 56 to provide a recess 62 between the flange and bottom wall of the tube. Near the junction of the other side wall and the bottom wall a lip 64 extends away from the bottom wall at a slight acute angle toward the glazing leg. An angular glass stop 66 adapted so that one leg fits in the recess 62 when the stop is snap engaged with lip 64, provides support for the glass 58 opposite the glazing leg and thus hold the glass in place.

From FIG. 2, it may be seen that the bottom rail 28 is also split into separate and lower portions 68, 70. The lower portion 70 is identical to the cross section of the upper portion 36 of the top rail 26, and the upper portion 68 is identical in cross section to the bottom portion 40 of the top rail 26. To avoid repetition, no further details with respect to the bottom rail 28 will be given at this time except to note that the bottom rail 28 includes at least 2 rollers 72. Typically, the rollers 72 are brass wheels mounted in on a housing 74 having an outwardly projecting flange 76. The rollers 72 are attached to the lower portion 70 of the bottom rail 28 by cutting slots in the bottom wall 78 and sliding or snapping the housing 74 into the slots. If required the flanges 76 can be attached to the bottom wall 78 with screws or other appropriate fasteners. It is understood that for purposes of this invention, the use of rollers is not required to provide a sliding support. As an alternative sliding shoes or pads might be attached to the rail instead of the rollers, for example.

A window of this invention has moveable sash which may be pivoted about a vertical axis at the midpoint to enable cleaning the exterior of the sash from the building interior.

Figure 4:
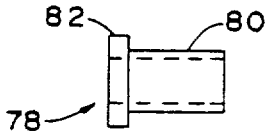
FIG. 4 is a side view of the bushing in the center pivot of a window of this invention.
Figure 3:
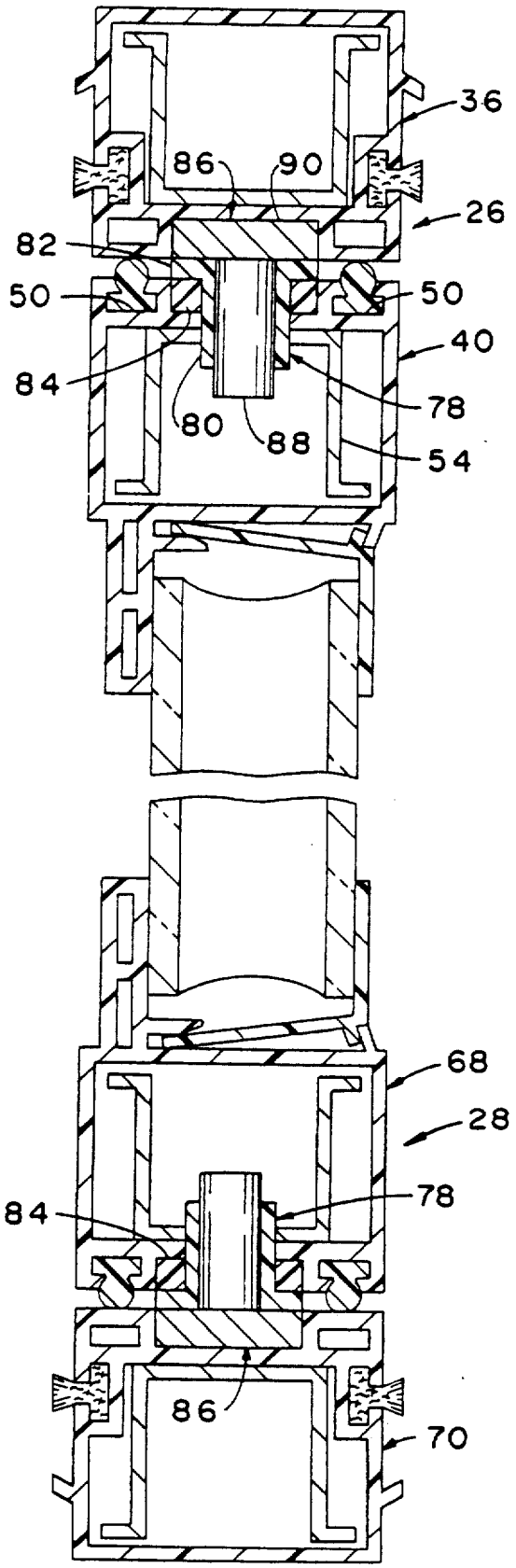
FIG. 3 is a vertical cross section at its center pivot of the sash of the window shown in FIG. 1 along Section III—III.

Referring now to FIG. 3, a typical sash is shown in cross section at its midpoint. Looking first at the top rail assembly 26, a circular opening is provided through the top wall of the rotating portion 40 and the web of the channel 54 at mid-length of these two members. The opening is sized to accommodate a snug fit with the hinge bushing 78 shown in FIG. 4.

The hinge bushing 78 has a center-bored cylindrical shank 80 with a circular flange 82 projecting outwardly therefrom on one end. The shank 80 is of sufficient length to project through the web of the channel 54 when the bushing is positioned as shown with the flange 82 supported by a bushing support 84 which fits within the central recess 51 of the rotating portion 40 of the top rail 26. It may be seen that the thickness of the flange 82 is important because the flange maintains the proper gap between the upper and lower rail portions 36, 40.

Figure 6:
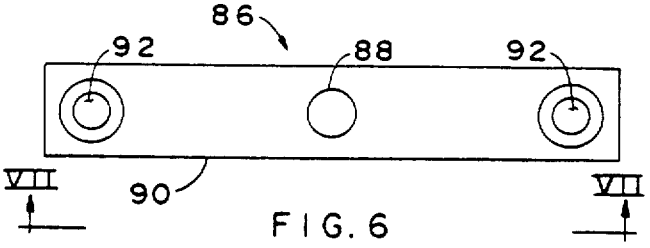
FIGS. 6 and 7 are top and side views respectively of a pivot pin assembly in a sash of this invention.
Figure 5:
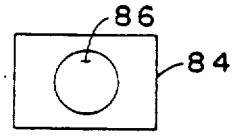
FIG. 5 is support for the bushing shown in FIG. 4.
Figure 7:
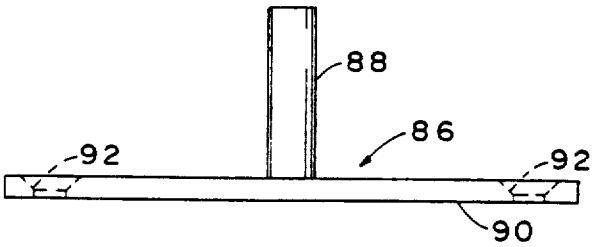

The bushing support 84 shown in FIG. 5, is a flat rectangular plate having a width and thickness which allows it to be seated snugly in the rail recess 51. A circular center opening 86 has a diameter to accommodate a snug fit around the bushing shank 80. The hinge pin 86 shown in FIGS. 6 and 7 is attached to the upper head rail portion 26 at its mid-length, and has a cylindrical shaft 88 which extends through the center bore of the bushing 78. The hinge pin 86 has a rectangular bar 90 as its base which has a width and thickness to fit it snugly in the recess 48 of the upper head rail portion 36. A pair of countersunk holes 92 near the ends of the bar accommodate attaching the hinge pin to the head rail portion 36 with a suitable flat head fastener. The cylindrical shaft 88 projects outwardly from the bar at its mid-point.

The components of this just described rotational assembly can be made of any materials suitable for providing long wearing rotational movement. Preferably the bushing 78 is made from an appropriate grade of nylon and the hinge pin 86 made of a corrosion-resistant grade of stainless steel.

Looking now at the bottom rail 28, the bushing support 84, bushing 78, and the hinge pin 86 are assembled with respect to the rotating portion 68 and fixed portion 70 as the comparable portions of the top rail. It may seem that providing a sash with split rails and hinge assemblies at its mid-point as just described makes it possible to freely rotate the glazed portion of the sash about a central vertical axis.

It is apparent that a means for maintaining the rotating portion of the sash in a fixed relationship with the non-rotating in the frame is necessary. In this preferred embodiment of the invention, such means is provided at the ends of the split rails.

Figure 8:
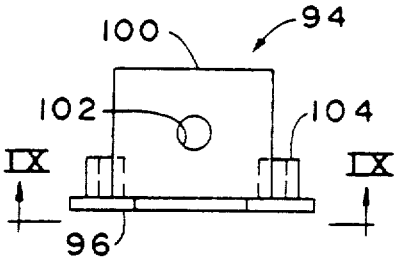
FIGS. 8, 9, and 10 are top, end and side views respectively of an end cap for closing the ends of non-rotating portions of split rails in a sash in a window of this invention.
Figure 10:
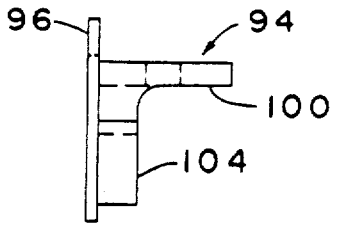
Figure 9:
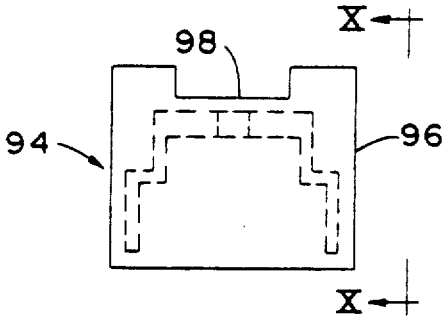

End caps are adapted to cap and plug the openings as well as maintain the split rails in an engaged position to prevent rotation except when desired. A first end cap 94, shown in FIG. 8, 9, and 10, is used in the ends of the non-rotating positions 36, 70 of the top and bottom rails 26, 28. An end plate 96 has out to out dimensions identical to the out to out dimensions of the rectangular tube of the portions 36, 70. A notch 98 in the upper edge of the plate has dimensions matching the recess 48 in the tube. An elongate relatively thick leg 100 extends away from the plate 96 at a distance from the top edge such that it fits within the tube in contact with he wall defining the bottom of the recess 48. A hole 102 through the leg is used to anchor a fastener which passes through the recess wall to attach the end cap 94 to the non-rotating rail portion 36, 70. A flange 104 also extends away from the plate 96 to fit against inner surfaces of the sidewalls of the tube to further enhance a tight fit.

Figure 13:
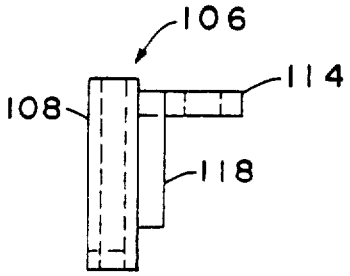
FIGS. 11, 12 and 13 are top, end, and side view respectively of an end cap for closing the ends of rotating portions of split rails in a window of this invention.
Figure 11:
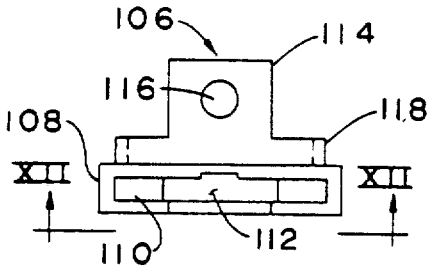
Figure 14:
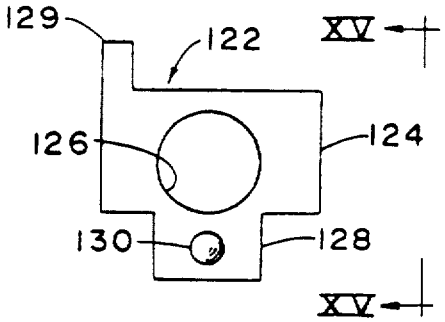
FIGS. 14 an 15 are front and side view respectively of a latch which assembles with the end cap shown in FIGS. 11, 12, and 13 to enable split rail portions of a sash of a window of this invention to be locked together.
Figure 12:
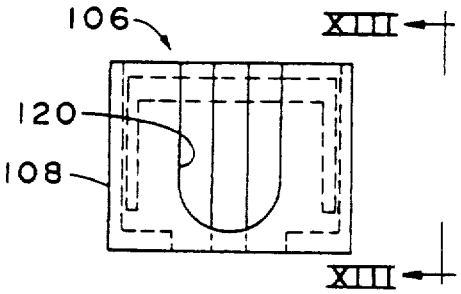
Figure 15:
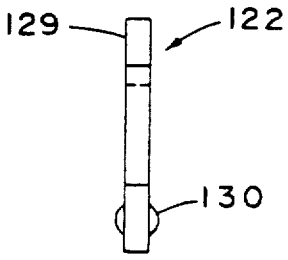

A second end cap 106 shown in FIGS. 11, 12, 13 closes off the ends of the rotating portions 40, 68 and is adapted to assist in locking the rotating portions with the non-rotating portions 36, 70. An end plate portion 108 has a cavity or pocket 110 therein extending downwardly from the top. There is a rectangular opening 112 through the bottom wall of the cavity which has the same length as the width of the recess 51 in the rail for a purpose which will be explained later. An elongated thickened leg portion 114 having an anchoring hole 116 extends away from the plate 108 to be used to attach the cap 106 to the rail. A flange 118 also extends away from the end plate to fit snugly against the sidewalls of the tube when the cap is in place in the rail. Assembly is made by inserting the leg 114 and the flange portions 118 into the tube with the leg 114 contracting the inner surface of the tube wall adjacent the glass portion of the sash and attaching a fastener through the rail wall into the anchoring hole 116. The front wall of the end plate 108 has a U-shaped opening 120 extending downwardly from the top to enable manipulation of a latch 122 shown in FIGS. 14 and 15 which fits within the cavity 110 of the second end cap 106.

The latch 122 has a flat plate 124 having a central opening 126 of sufficient size to accommodate the tip of one's finger. The width of the plate 124 is slightly less than the width of the end caps cavity 110 to provide a smooth sliding fit. A locking tab 128 having a width approximately equal to the width of the recess 48 in the fixed rail extends away from the bottom edge of the latch plate 124. A narrow tab 129 extends upwardly from the top edge of the plate 124 at a side edge of the plate for a reason to be explained later. A knob 130 projects outwardly from the outward of the locking tab 128 to lock the latch 122 in place as will now be explained.

Figure 16:
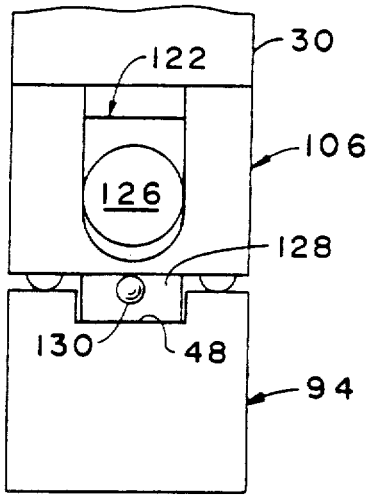
FIG. 16 is a front view of an assembly of the latch shown in FIGS. 14 and 15 and the end cap shown in FIGS. 11, 12 and 13 with the latch in an engaged position with respect to the end cap shown in FIGS. 8, 9, and 10.

Referring now to FIG. 16, the split rails of the sash are locked in place. The latch 122 is within the cavity in the second end plate 106 with the locking tab 128 projecting through the bottom opening of the cavity and fitting within the recess 48 in the rail. The knob 130 projecting outwardly from the outer surface of the tab 128 and contracting the bottom of the second end cap 106 cavity wall maintains the locking tab 128 in place.

With a latching arrangement as just described at each corner of the sash, the rotatable sash portion is firmly engaged with the non-rotating portion. To disengage the latches 122, a finger or implement, such as a pencil or a screwdriver, is inserted in the opening and pressure is applied either upwardly or downwardly as required to disengage a particular latch. Since the cavity wall at the base of the U-shaped opening 120 is relatively thin, narrow, and flexible and the knob 130 has a rounded outer surface, only a relatively light pressure is required to flex the cavity wall and enable the tabs 128 to be cleared from the recesses. When the sash is slid open to an extent that all of the latches are accessible, they can easily be disengaged and the sash pivoted about its center hinged connection to clean the exterior of the sash.

Figure 23:
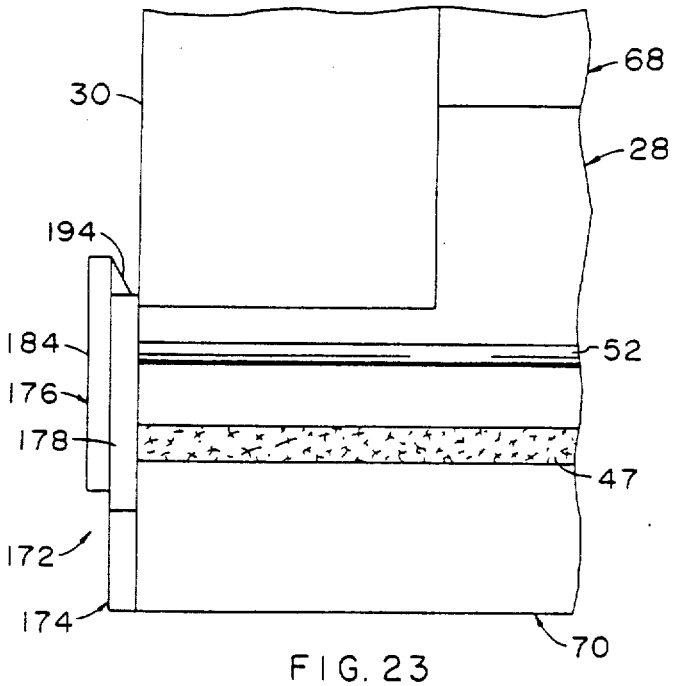
FIG. 23 is a side view of a corner joint of the bottom rail and stile in an alternate embodiment of a window of this invention.
Figure 25:
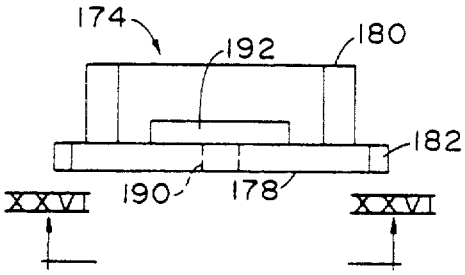
FIG. 25 is a top view of the cap body in the end cap assembly shown in FIG. 24.
Figure 29:
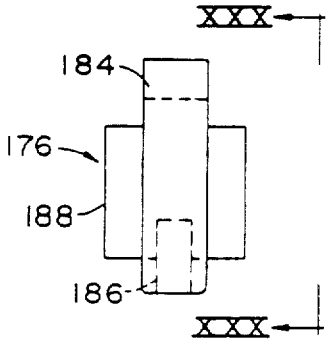
FIG. 29 is an end view of the slidable latch shown in FIG. 28.
Figure 30:
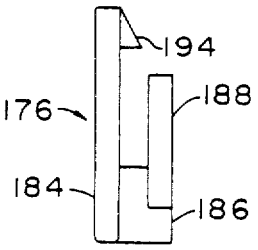
FIG. 30 is a side view of the slidable latch shown in FIGS. 28 and 29.
Figure 26:
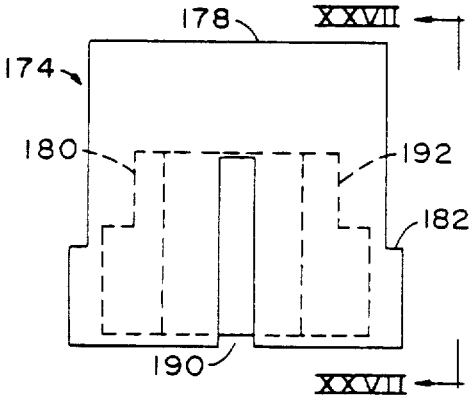
FIG. 26 is a front view of the cap body shown in FIG. 25.
Figure 27:
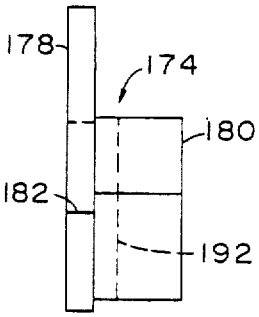
FIG. 27 is a side view of the cap body shown in FIGS. 25 and 26.
Figure 28:
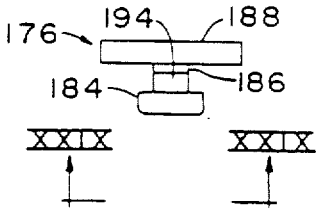
FIG. 28 is a top view of the slidable latch in the end cap assembly shown in FIG. 24.

In an alternate embodiment of this window a mitered joint or modified butt joint is used to connect rotating rail portions to stiles which eliminates the need for an end cap on the rotating rail portion. An exemplary butt joint of this type is shown in FIG. 23. Prior to assembly, the end of the rotating portion 68 of the bottom rail 28 as shown in FIGS. 1 and 2 is cut back for a distance equal to the depth of the stile 30 except for the bottom wall. Assembly of the rail and stile ends can then be made by using an interior corner spline in a manner well known to one skilled in the art or welding along the seam between the two members. If, as an alternate, a mitered joint is used, it too can be made using a corner spline or seam welding. In either case, it can be seen that the stile closes the end of the rotating rail portion without the necessity of using an end cap. To prevent the sash from rotating when it is in a closed position, a selective interlock between the rotating and non-rotating portions of the rail is used which will now be explained with reference to FIGS. 24–FIG. 30.

The end cap assembly 172 is comprised of a cap body 174 and a slidable latch 176. The cap body 174 has an end plate 178 with a plug 180 extending away therefrom. The end plate 180 is rectangular and sized to completely cover the end of the non-rotating rail portion 70 and the bottom wall of the rotating rail portion 68. Along the lower portion on each side of the plate, an outwardly projecting flange 182 is provided for a purpose to be explained later. The plug 180 is configured and sized to slidably fit within the cavity of the non-rotating rail portion 70 and is secured therein with fasteners extending through the bottom wall of the rail into the plug.

The latch 176 has a rectangular tab 184 with a rectangular arm 186 extending away therefrom and has a rectangular plate 188 attached to its end. The latch plate 188 is sized in width to slidable fit within the recess 51 of the rotating rail portion 68 as may be seen in FIG. 2. The latch 176 is slidably assembled with the cap body 174 by sliding the latch arm 186 into the slot 190 in the body 174. A rectangular opening 192 in the plug 180 is sized to slidably accommodate the plate 188 therethrough.

Figure 24:
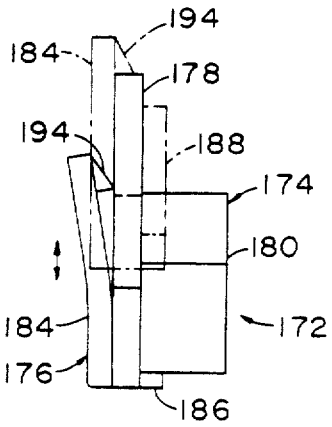
FIG. 24 is a side view of an alternate embodiment of an end cap assembly for use in the non-rotating rail portion of a window of this invention.

As may be seen in FIG. 24, with the latch 176 assembled in the cap body 174 it can be slidably move upwardly from a retracted position by manipulation of the tab 184. In an extended position, shown in dashed lines, a wedge-shaped catch 194 engages the top edge of the end plate 178 and holds the latch plate 188 in an extended position. In this extended position the latch plate 188 is seated in the recess 51 in the rotating portion of the rail and keeps it locked in place. To free the sash for rotation, the catch 194 is pried outward and the tab slid downward. It is apparent that another mode of interlock could be substituted for the latch and rail recess combination. Foe example, a pin attached to the latch arm 186 to fit slidably through an opening in the rail bottom wall could also function as an interlock in a window of this invention.

As noted earlier, the end plate 178 of the end cap 172 has a flange 182 extending outward from its side edges. The purpose of this ledge is to provide a sliding interlock with the upwardly projecting lip 45 on the frame head 14 or sill 16 as may be seen in FIG. 2, for example. Thus an end cap of this embodiment functions to prevent the rotating portion of the sash from racking or twisting when it is rotated to its open position for cleaning. The cap flange 182, therefore, performs the same function as the outwardly projecting lip 43 on the non-rotating portion 36 of the rail and the lip 43 can be eliminated.

It was noted earlier that the opposing lips 43, 45 were provided on the frame 14 and sill 16 and on the top and bottom sash rails 26, 28. The purpose of these opposing lips is to provide a positive interlock between the sash and frame and maintain retention of of the non-rotating sash portion in the frame when the rotatable portion has been rotated for cleaning. It may be seen that when the two portions are unlatched for rotation, they are connected only by the center hinge. Without the opposing lips in the rail portions, or a end cap in the non-rotating rail portion with a flange 182 to slidably interlock with outwardly projecting lip 45 on each side of the frame head 14 or sill 16, it would be possible, when the rotatable sash portion is swung into the room, to rack or twist it to an extent that the non-rotating rail portions would be cleared from the frame. The more the sash is skewed from vertical by twisting, the less the vertical distance between the non-rotating top and bottom rail portions with the result that one or both might be cleared from the frame allowing the sash to fall therefrom. As may be seen, the opposing lips between the frame and sash on each side of the sash, or a end cap in the non-rotating sash portion with a ledge to slidably interlock with the lip on the frame on each side of the sash, prevent such an event from happening. It is noted that an alternate interlock means might be provided. For example, holes could be provided in the non-rotating rail and frame member which become aligned for insertion of a pin when the sash is slid to a position suitable for rotation of the rotatable sash portion. It is evident that providing opposing interlocking lips is preferred since the rotatable sash portion can be rotated at any point that the sash stile is clear of the window jamb rather than only at a specific point to effect a pin connection.

Infiltration of wind and rain through a window of this invention is prevented by two separate systems of weather stripping which may be seen in FIG. 2. One system is that which effects a seal between sash and frame members. This system includes weather-stripping 44, 47 which fits in recesses 36, 70 of the top and bottom rails. Like weather-stripping is provided between the pull stiles 22, 24 and frame jambs 18, 20 on each side of the stiles. A wide variety of materials and types of weather-stripping are known and available for use in this system, but the preferred type for this embodiment is mohair.

The second weather stripping system is that between the rotating and non-rotating portions of the sash rail members. A continuous length of weather-stripping 52 seats in a recess 50 on each side of the rotating portion 40 of the upper sash rail 26. When the sash is in a closed position, the weather-stripping is in tight contact with the non-rotating portion 36 of the upper sash rail. Weather-stripping between the rotating and non-rotating portions of the bottom rail is identically provided. It is noted that as an alternative, the weather-stripping may be in the non-rotating rail portion 36, rather than the rotating rail portion 40. Although other weather-stripping materials may be used, the preferred material for this system is a tubular foam core plastic.

The effectiveness of this weather stripping is enhanced by the pressure equalization chamber formed by the opposing recesses 48, 51 in the non-rotating and rotating sash portions 36, 40. Since the size of this chamber is relatively large in comparison to any small gap which might exist between the weather-stripping and an opposing non-rotating sash portion, the pressure of the air passing through the small gap immediately drops. Thus, there is essentially no pressure differential between the chamber and the interior side of the sash to drive air or moisture through the inner seal. To the extent that moisture gets into the chamber from a wind driven rain, for example, it drains away to the end of the rail to the frame and is discharged to the outside through weep holes in the sill.

Figure 18:
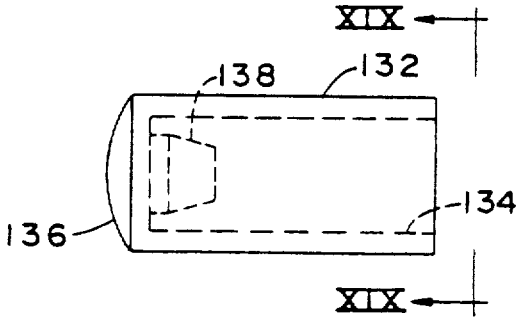
FIGS. 18 and 19 are side and end views respectively of the plunger shown in FIG. 17.
Figure 19:
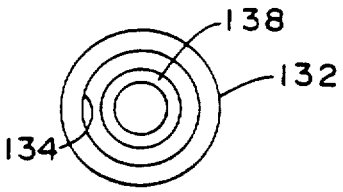

It may be seen that it is important that a tight contact be maintained between the weather-strip and the non-rotating portions 36, 70 of the top and bottom rails 26, 28. To insure that a proper space is maintained between the rotating and non-rotating portions provide weather sealing along the seam without unduly restricting rotation of the rotatable sash portion, spring regulated pressure is applied to the non-rotating portion 36 of the top rail 26. The manner in which such pressure is supplied can be seen with reference to FIGS. 17, 18 and 19. On each end of the upper rail portion 36, a spring loaded plunger 132 extends from the base 133 of the channel 46 through an opening in the top wall of the non-rotating portion 36 of the top sash rail and presses against the top wall of the frame head 14.

The plunger 132 is cylindrical and preferably made of nylon. It has a center bore 134 and an arcuate surfaced closed end 136. A frusto-conical center post 138 extends away from the closed end inside the center bore 134.

Figure 17:
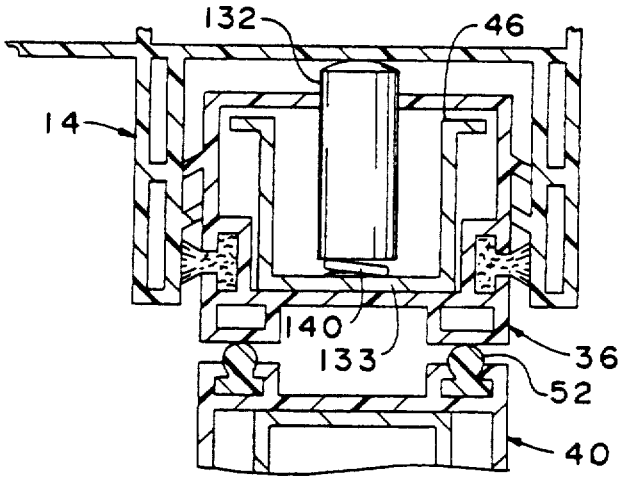
FIG. 17 is a cross sectional view of a fragmentary portion of a frame head and top rail of a sash of this invention showing a spring mounted plunger through the non-rotating portion of the top rail of a sash of a window of this invention.

A spring 140 having suitable compressibility is inserted into the plunger center bore 134 over the center post 138 and when a plunger 132 is positioned as shown in FIG. 17 on each end of the sash, the non-rotating portion 36 is held in tight contact against the flange 82 of the bushing 80 as shown in FIG. 3 to maintain the desired gap between the rail portion 36, 40. Because of the arcuate surface 136 in contact with the frame head 14 and use of a low-coefficient of friction material like nylon for the plunger, this spring loaded device does not interfere with the sliding sash. The spring loaded plungers coupled with the weight of the glass in the sash assure that a tight seal is maintained between the split portions of the bottom rail.

Figure 20:
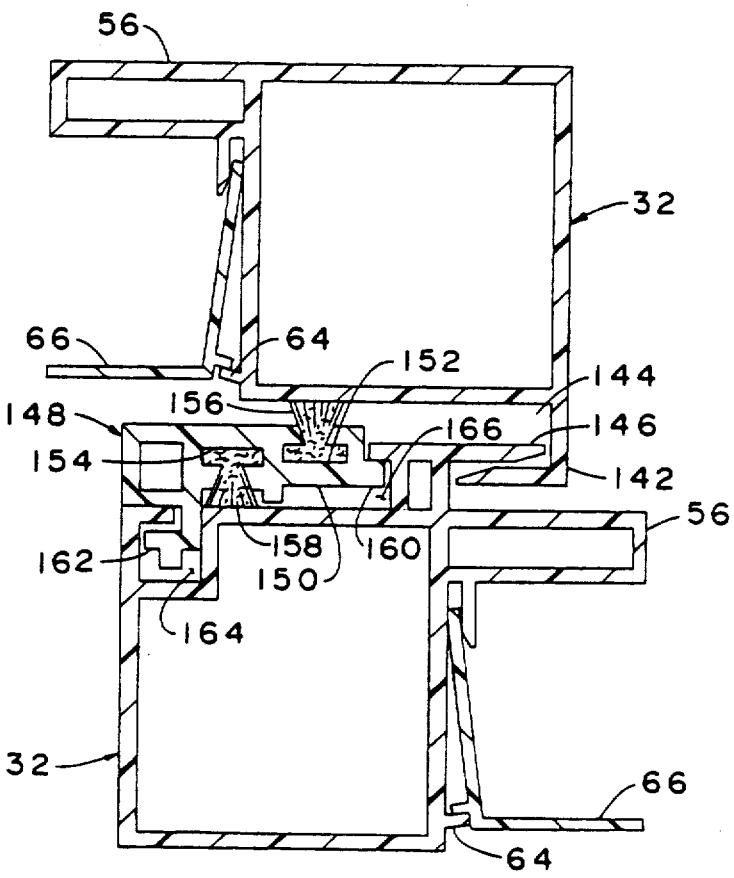
FIG. 20 is a cross sectional view of the meeting stiles of a window of this invention showing a selectively movable weather-strip member therebetween.

An additional important and beneficial weather-stripping is between the meeting stiles. Referring now to FIG. 20 the left and right meeting stiles 32, 32 of the window in FIG. 1 are shown in an engaged position as when the sliding sash are closed. Like the rails in this embodiment, the stiles are made of plastic and each gas a glazing leg 56, lip 64, and glass stop 66 for holding the glass in place. A tubular aluminum extrusion which is not shown extends the length of the hollow interior of the stiles 32, 32 for strength and providing convenient features for making connections with the rails. Use of such extrusions is well known to those skilled in the art and are omitted since they are not necessary for describing this invention. The stile 32 of the left sash from FIG. 1 has and angle 142 projecting away from its outer end and side wall intersection to form a pocket 144. The stile 32 of the right hand sash likewise has an angle 146 projecting away from its sidewall. Al may be seen legs of these opposing angles slide past one another and assist in maintaining the stiles in close proximity to one another as well as closing the space between the two.

Since stiles of a window of this invention terminate at the rails in order to enable rotation of the glazed portion of the sash, a conventional weather-stripping system would not be effective for sealing between the two sash at the stiles for the full height of the window. To solve this problem, a slidable retractable weather-strip member 148 is connected with the right hand sash stile. The member 148 has a rectangular body 150 which includes a weather-strip pocket 152, 154 on each side. The weather-stripping 156, 158, which is preferably mohair, in each of these pockets presses tightly against the stiles. A flange 160 projecting from one end of the body 150, and a hook 162 adjacent to the other end fit into the recesses 164, 166 in the stile to hold the member slidably in place.

Figure 21:
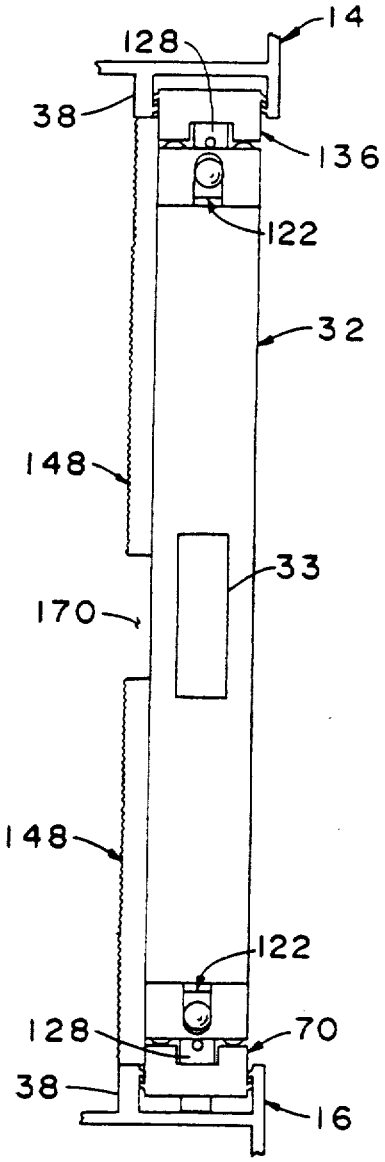
FIG. 21 is an end view of a sash of this invention and a fragmentary portion of the frame which shows retractable weather-strip members in their fully extended position.
Figure 22:
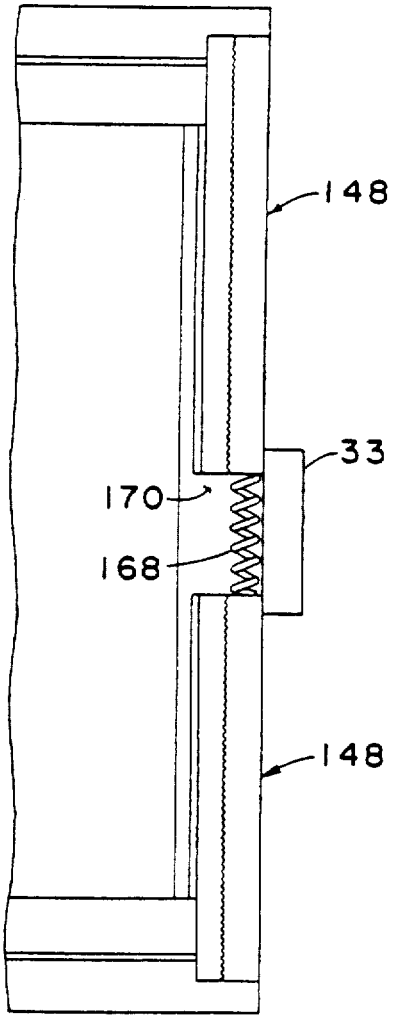
FIG. 22 is a side view of a fragmentary portion of the sash shown in FIG. 21 with the frame portions removed.

Referring now to FIGS. 21 and 22, a pair of weather-strip members 148, 148 are shown in the position they occupy on the stile 32 when the rotating sash portion is locked against rotation with latch 122. In this position, the ends of the weather-strip members 148, 148 are in abutting contact with flanges 38, 38 of the frame head and sill 14, 16. They are held and maintained in this position by a spring 168 which fits between them within the recess 164 in the stile and pushes on the ends of the hook 162 in the weater-strip members. It may be seen that in this position, the extending weather-strip members 148, 148 interfer with and prevent rotation of the rotatable sash portion. It is also evident that a portion of the hook 162 adjacent to the ends of the members as seen in FIG. 20 must be cut away to permit the end portions of the members to pass by the non-rotating rail portions. Retraction of the member 148 to enable rotation of the rotatable sash portion is accomplished with movement of the latch 128 to disengage the rotatable sash portion from the upper and bottom rail portions 36, 70.

Referring once again to FIG. 14, the latch includes a tab 129 ectending away from the plate portion 124. When the latch is assembled with the end cap 106 as shown in FIG. 16, the tab 129 fits into and slides within the recess 164 of the stile 32. To accommodate the fitting of the tab 129 in the recess, a portion of the hook 162 on the weather-strip member 148 is cut away. Thus, the tab 129 contacts the hook 162 in the assembly and when the latch 122 is moved for disengagement, the weather-strip member 148 is retracted a distance sufficient to clear the upper and lower members 36, 70. retraction of the member 148 causes at least some compression of the spring 168 to provide the force required to again cause extension of the member when the latch 122 is moved to re-engage the rotating and non-rotating sash portions.

The gap 170 between the two weather-strip members 148, 148 is provided to accommodate a keeper plate (not shown) portion of a lock which is attached to the stile of the left hand sash. At least a portion of the gap is also used to provide the space needed for retraction of the weather-strip members 148, 148. The latch portion 33 of the lock is operated to engage with the keeper to not only lock the sash, but to draw the stiles toward one another and compress the weather-strip. When the sash are in a closed position in the window, the fit of the keeper plate within the gap 170 is sufficiently tight to prevent any appreciable infiltration of air at the lock. Since camming locks like that briefly discussed are well know to those skilled in the art no further details with respect thereto are necessary for the purpose of describing this invention.

While the invention has been described in terms of preferred embodiments, the claims appended hereto are intended to encompass all embodiments which fall within the spirit of the invention.

What is claimed is:

1. A window comprising:

a frame adapted for attachment in a wall opening:

at least two sash within the frame with at least one sash slidably movable therein:

the at least one slidably movable sash have a pair of open-ended opposing first members split lengthwise into an inner portion and an outer portion with the outer portions slidably movable within the frame and the inner portions capable of being rotated with respect to the outer portions and the frame about a midlength pivot connection between the inner and outer portions, and a pair of second members having opposing ends of each of the second members attached to opposing ends of the inner portions whereby the second members and the inner portions define a rotatable sash portion suited for glazing; and means for capping the open ends of the outer first member portions with the cap means including means for selectively locking or unlocking the inner and outer portions together to prevent or enable rotation of the rotatable sash portion.

2. A window as claimed in claim 1 wherein the locking means includes a slidable plate and means for selectively engaging the plate.

3. A window as claimed in claim 2 wherein the plate is slidably retained in a portion of the cap means and the plate engaging means has a notch in a second portion of the cap means to receive and accommodate a portion of the plate therein whereby the inner and outer first member portions are locked together when the plate portion is within the notch.

4. A window as claimed in claim 1 wherein the window is a horizontal sliding window and the first members are top and bottom rails and the second members are stiles.

5. A window as claimed in claim 1 wherein the open ends of the inner portions of the first members are closed by second member end portions.

6. A window as claimed in claim 1 which further includes means for preventing the rotatable sash from racking or twisting when such portion is rotated to an open position.

7. A window as claimed in claim 6 wherein the rotatable sash portion is capable of rotation independent of any predetermined position with respect to the frame.

8. A window as claimed in claim 6 wherein the means for preventing the rotatable sash portion from racking or twisting when such portion is rotated to an open position is included in the cap means.

9. A window as claimed in claim 8 wherein the means for preventing the rotatable sash portion from racking or twisting is a sliding interlock assembly between the cap means and the frame.

10. A window as claimed in claim 1 which further includes means for capping open ends of the inner first member portions.

11. A window as claimed in claim 10 wherein the locking means includes a latch in the inner member portion cap means which is slidably movable selectively to engage or disengage a portion of the outer member portion.

* * * * *